US006478860B1

(12) United States Patent
Nakayama et al.

(10) Patent No.: US 6,478,860 B1
(45) Date of Patent: Nov. 12, 2002

(54) CONDITIONING METAL SURFACES BEFORE PHOSPHATING THEM

(75) Inventors: Takaomi Nakayama, Hirastuka (JP); Yasuhiko Nagashima, Nagoya (JP); Kensuke Shimoda, Hirastuka (JP); Hirokastu Bannai, Hirastuka (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/744,168

(22) PCT Filed: Jul. 21, 1999

(86) PCT No.: PCT/US99/14156

§ 371 (c)(1),
(2), (4) Date: Jan. 22, 2001

(87) PCT Pub. No.: WO00/05066

PCT Pub. Date: Feb. 3, 2000

(30) Foreign Application Priority Data

Jul. 21, 1998 (JP) ..... 10-204635
May 12, 1999 (JP) ..... 11-131974

(51) Int. Cl.[7] ..... B32B 15/04; C04B 9/02; C23C 22/07; C23C 22/82; C23C 28/00

(52) U.S. Cl. ..... 106/14.05; 106/14.12; 106/14.44; 148/256; 148/259; 428/472.3

(58) Field of Search ..... 106/14.05, 14.12, 106/14.44; 148/256, 259; 428/472.3

(56) References Cited

U.S. PATENT DOCUMENTS 2,310,239 A 2/1943 Jernstedt
2,322,349 A 6/1943 Jernstedt
2,874,081 A 2/1959 Cavanagh et al.
3,625,777 A * 12/1971 Okabe et al. ..... 148/259

OTHER PUBLICATIONS

JP 63–076883—Apr. 07, 1988—Questel Orbit Accession No. 1988–266443[38]; Sec. Acc. no. CPI:C1988–118487—Derwent Manual code: CPI; M14–D02; Derwent Class M14.

JP 56–616778—Dec. 03, 1981—Questel Orbit Accession No. 1982–04576E[03]—Derwent Manual code: CPI:M24–D02; Derwent Classes: M14, M24.

JP 57–023066—Feb. 6, 1982—Questal Orbit Accession No. 1982–20885E[11]; Derwent Manual code: CPI:M14–D02 M24–D02; Derwent Class: M142.

* cited by examiner

*Primary Examiner*—Nathan M. Nutter
(74) *Attorney, Agent, or Firm*—Stephen D. Harper; Arthur G. Seifert

(57) ABSTRACT

A highly effective and storage stable conditioning treatment for metal surfaces prior to phosphating them is a suspension in water containing solid miorosize particles of at least one phosphate of a divalent or trivalent metal and an accelerant selected from the group consisting of sacoharides and their derivatives thereof, orthophosphoric acid, condensed phosphoric acids, organophosphonic acids, and polymers of vinyl acetate and/or carboxylic acid. The surface conditioning liquid composition is used simply by effecting contact between the metal and the liquid composition, and can also be used to simultaneously carry out degreasing, particularly when the conditioning liquid also contains nonionic or anionic surfactant.

25 Claims, No Drawings

CONDITIONING METAL SURFACES BEFORE PHOSPHATING THEM

FIELD AND BACKGROUND OF THE INVENTION

This invention generally concerns the art of phosphate conversion coating treatments that are executed on the surfaces of such metals as iron, steel, zinc-plated steel sheet, aluminum, and magnesium alloys. More specifically, the invention concerns a composition and process for conditioning metal surfaces prior to such conversion treatments in order to accelerate the conversion reactions, shorten the treatment time, and microsize the phosphate coating crystals.

The formation of dense, microfine phosphate coating crystals is considered desirable both within the realm of automotive phosphate treatments and within the realm of the phosphate treatments associated with plastic working. The formation of such a coating is considered desirable in the former case in order to improve the post-painting corrosion resistance and in the latter case in order to reduce friction during pressing and extend the life of the press tool. In order to obtain dense, microfine phosphate coating crystals, a surface conditioning process is executed prior to the phosphate conversion coating treatment, with a goal of activating the metal surface and producing nuclei for deposition of the phosphate coating crystals. The following treatment sequence is a generalized example of the phosphate conversion coating processes used to produce dense, microfine phosphate coating crystals:

(1) Degreasing;

(2) Tap water rinse (multistage);

(3) Surface conditioning;

(4) Phosphate conversion coating treatment;

(5) Tap water rinse (multistage);

(6) Purified water rinse.

The surface conditioning step is used to induce the formation of dense, microfine phosphate coating crystals. Compositions used for this purpose are known from, for example, U.S. Pat. Nos. 2,874,081, 2,322,349, and 2,310,239, in which titanium, pyrophosphate ions, orthophosphate ions, and sodium ions are disclosed as the main constituent components in the surface conditioning agent. These surface conditioning compositions, known as jernstedt salts, contain titanium ions and titanium colloid in aqueous solution.

The titanium colloid becomes adsorbed on the metal surface when the degreased, water-rinsed metal is dipped in or sprayed with an aqueous solution of the surface conditioning composition. The adsorbed titanium colloid forms nuclei for deposition of the phosphate coating crystals in the ensuing phosphate conversion coating treatment and thereby supports and induces an acceleration of the conversion reactions and a microfine-sizing and densification of the phosphate coating crystals. The surface conditioning compositions currently in commercial use all employ Jernstedt salts, but a number of problems have been associated with the use in surface conditioning processes of titanium colloids obtained from Jernstedt salts.

A first problem is the timewise deterioration in the surface conditioning liquid composition. Aqueous solutions that have just been prepared from the prior-art surface conditioning compositions are in fact very effective in terms of microfine-sizing and densification of the phosphate coating crystals. However, within several days after preparation of the aqueous solution, these baths suffer from a loss of activity due to aggregation of the titanium colloid—regardless of whether or not the surface conditioning liquid composition has been used during this period of time. This loss of activity results in a coarsening of the phosphate coating crystals.

In order to deal with this problem, Japanese Laid Open (Kokai or Unexamined) Patent Application Number Sho 63-76883 (76,883/1988) has disclosed a method for maintaining and managing the surface conditioning activity. In this method, the average particle size of the titanium colloid in the surface conditioning liquid composition is measured and the surface conditioning liquid composition is continuously discharged so as to maintain the average particle size below a specific constant value. In addition, surface conditioning composition is supplied in an amount sufficient to compensate for the amount discharged. While this method does make possible a quantitative management of the primary factor related to the activity of the surface conditioning liquid composition, it also requires the discharge of surface conditioning liquid composition in order to maintain the activity. Moreover, this method requires the discharge of large amounts of surface conditioning liquid composition in order to maintain the same liquid composition activity as in the initial period after preparation of the aqueous solution. This creates issues with regard to the waste water treatment capacity of plants that employ this method, and as a result the activity is actually maintained through a combination of continuous discharge of the surface conditioning liquid composition and total renewal.

A second problem is that the activity and life of the surface conditioning liquid composition depend strongly on the quality of the water used for surface conditioning liquid composition build up. Industrial water is typically used to build up surface conditioning baths. However, as is well known, most industrial water contains cationic components, e.g., calcium and magnesium, that make the water "hard", and the content of this component varies as a function of the source of the industrial water. It is known that the titanium colloid which is the main component of the prior-art surface conditioning baths carries an anionic charge in aqueous solution and is maintained in a nonsedimenting, dispersed state by the corresponding electrical repulsive forces. When the cationic component in industrial water is present in a large amount, the titanium colloid is electrically neutralized by the cationic component, so that the electrical repulsive forces are no longer effective and the activity of the titanium colloid is thereby nullified due to the occurrence of aggregation and sedimentation.

The addition of condensed phosphates such as pyrophosphates to surface conditioning baths has been proposed in order to sequester the cationic component and thereby maintain the stability of the titanium colloid. However, when added in large amounts to a surface conditioning liquid composition, the condensed phosphate reacts with the surface of the steel sheet to form a coating, which results in the production of conversion defects in the ensuing phosphate conversion coating treatment. Finally, in localities that suffer from very high magnesium and calcium concentrations, the surface conditioning liquid composition must be built up and supplied with water using pure water, which is very uneconomical.

A third problem involves the temperature and pH conditions that must be used during the surface conditioning process. Specifically, surface conditioning activity cannot be generated at a temperature in excess of 35° C. and a pH outside 8.0 to 9.5 due to aggregation of the titanium colloid.

This has necessitated the use of very specific temperatures and pH ranges when using the prior-art surface conditioning compositions. This has also made it impossible to achieve cleaning and activation of metal surfaces on a long-term basis using a single liquid composition formulated by the addition of surface conditioning composition to a degreaser.

A fourth problem is the lower limit on the microfine-sizing of the phosphate coating crystals that can be obtained through the activity of the surface conditioning liquid composition. The surface conditioning activity is obtained by the adsorption of the titanium colloid on the metal surface to form nuclei for deposition of the phosphate coating crystals. Thus, finer, denser phosphate coating crystals will be obtained as larger numbers of colloidal titanium particles become adsorbed on the metal surface during the surface conditioning process.

From this one might at first draw the conclusion that the number of titanium colloid particles in the surface conditioning liquid composition should simply be increased, i.e., that the concentration of the titanium colloid should be raised. However, when this concentration is increased, the frequency of collisions among the colloidal titanium particles in the surface conditioning liquid composition is also increased, and these collisions cause aggregation and precipitation of the titanium colloid. At present the upper limit on the usable titanium colloid concentration is $\leqq 100$ parts per million by weight, hereinafter usually abbreviated as "ppm", and it has been impossible in the prior art to obtain additional microfine-sizing of phosphate coating crystals simply by increasing the titanium colloid concentration beyond this level.

These problems have resulted in the appearance of methods that use surface conditioning agents other than Jernstedt salts. For example, Japanese Laid Open (Kokai or Unexamined) Patent Application Numbers Sho 5-156778 (156,778/1981) and Sho 57-23066 (23,066/1982) disclose surface conditioning methods in which the surface of steel strip is pressure-sprayed with a suspension containing the insoluble phosphate salt of a divalent or trivalent metal. However, since these methods manifest their effects only when the suspension is pressure-sprayed against the workpiece, they often cannot be used for surface conditioning in existing phosphate conversion coating treatment plants where this surface conditioning is carried out by ordinary dipping or spraying.

Japanese Published Patent Application (Kokoku or Examined) Number Sho 40-1095 (1,095/1965) has disclosed a surface conditioning method in which zinc-plated steel sheet is immersed in a very concentrated suspension of the insoluble phosphate salt of a divalent or trivalent metal. The working examples provided for this method are limited to zinc-plated steel sheet and have to use very high concentrations of insoluble phosphate salt of at least 30 grams per liter, hereinafter usually abbreviated as "g/L", at a minimum in order to obtain surface conditioning activity.

In sum, then, notwithstanding the various problems associated with Jernstedt salts and the various tactics that have been proposed for dealing with these problems, up to now there has yet to appear a technology capable of replacing the use of Jernstedt salts in practical phosphating operations.

The present invention seeks to solve at least one of the problems described hereinabove for the prior art and takes as its object the introduction of a novel, highly time-stable surface conditioning liquid composition and process that can be used to achieve at least one of an acceleration of the conversion reactions, a shortening of the treatment time in phosphate conversion coating treatments, and inducement of microfine-sized phosphate coating crystals.

BRIEF SUMMARY OF THE INVENTION

The inventors discovered that solid divalent or trivalent metal phosphate powder of a particular size and concentration (i) will adsorb onto the surface of a metal workpiece in an aqueous solution that contains a particular accelerant component to form nuclei for the ensuing deposition of phosphate coating crystals and (ii) will provide additional improvements in the reaction rate of the phosphate conversion treatment. The major compositional invention accordingly is a surface conditioning liquid composition that characteristically contains at least one phosphate powder selected from phosphates that contain at least one divalent and/or trivalent metal and are sufficiently low in water solubility to remain in the solid state when dispersed as a fine powder in the surface conditioning liquid composition and also contains as accelerant component at least one selection from the group consisting of the following subgroups:

(1) monosaccharides, polysaccharides, and derivatives thereof;

(2) orthophosphoric acid, condensed phosphoric acids, and organophosphonic acid compounds;

(3) water-soluble polymers that are homopolymers or copolymers of vinyl acetate and derivatives of these homopolymers and copolymers;

(4) copolymers and polymers as afforded by the polymerization of:

(a) at least one selection from:

monomers, exclusive of vinyl acetate, that conform to general chemical formula (I):

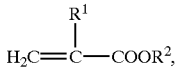

(I)

where $R^1$=H or $CH_3$ and $R^2$=H, $C_1$ to $C_5$ alkyl, or $C_1$ to $C_5$ hydroxyalkyl; and other α,β-unsaturated carboxylic acid monomers; and, optionally, (b) not more than 50% by weight of monomers that are not vinyl acetate and are not within the description of part (a) immediately above but are copolymerzable with said monomers that are within the description of said part (a).

DETAILED DESCRIPTION OF THE INVENTION AND ITS PREFERRED EMBODIMENTS

The total accelerant component selected from immediately previously recited subgroups (1) to (4) preferably has a concentration from 1 to 2,000 ppm in said surface conditioning liquid composition.

The aforesaid phosphate powder preferably includes particles with sizes no greater than 5 micrometers, hereinafter usually abbreviated as "μm", and independently is preferably present at a concentration from 0.001 to 30 g/L, more preferably at least, with increasing preference in the order given, 0.01, 0.10, 0.30, 0.50, 0.70, 0.90, or 0.99 g/L. Moreover and independently, the divalent and/or trivalent metal present therein is preferably at least one selection from Zn, Fe, Mn, Ni, Co, Ca, and Al.

In a preferred embodiment said surface conditioning liquid composition also contains alkali metal salt, ammonium salt, or a mixture of alkali metal salt and ammonium salt. This alkali metal salt or ammonium salt is preferably at least one selection from orthophosphate salts, metaphosphate salts, orthosilicate salts, metasilicate salts, carbonate salts, bicarbonate salts, nitrate salts, nitrite salts, sulfate salts, borate salts, and organic acid salts and independently is preferably present at a concentration of 0.5 to 20 g/L.

A process according to the present invention for conditioning metal surfaces prior to the phosphate conversion coating treatment thereof characteristically comprises effecting contact between the metal surface and a surface conditioning liquid composition according to the invention as described above.

The surface conditioning liquid composition according to the present invention has a much better high-pH stability and high-temperature stability than the colloidal titanium of the prior art and as a consequence, through the addition to this liquid composition of alkali builder plus nonionic or anionic surfactant or mixture thereof, can also be used in a process for simultaneously executing degreasing and surface conditioning in which the metal surface is both cleaned and activated.

An example is provided below of the separate operations of a phosphate conversion coating treatment in which the surface conditioning liquid composition according to the present invention is used for degreasing and surface conditioning in a single process operation:

(1) degreasing and surface conditioning in a single process operation;

(2) phosphate conversion coating treatment;

(3) tap water rinse (multistage); and (4) pure water rinse.

The use of the surface conditioning liquid composition according to the present invention to effect degreasing and surface conditioning in a single process operation makes possible omission of the water rinse step between degreasing and surface conditioning—a feature heretofore unavailable in the prior art. Moreover, since the surface conditioning liquid composition according to the present invention can be used over a broad pH range and can tolerate the addition of various alkali metal salts, the degreasing and surface conditioning in a single process operation that is identified as process operation (1) above can be preceded by a preliminary cleaning or a preliminary degreasing depending on the particular surface contamination status of the metal workpiece.

The essential components in the present invention are the accelerant component and the metal phosphate powder selected from phosphates that contain at least one divalent and/or trivalent metal (hereinafter usually abbreviated simply as the "phosphate powder"). This phosphate powder, being a component that is the same as or similar to that in phosphate conversion baths and phosphate conversion coatings, will not negatively affect the phosphate conversion liquid composition even when carried over thereinto. Another advantage to this phosphate powder is that it also does not negatively affect the performance of the phosphate conversion coating even when taken into the phosphate conversion coating through formation of the nuclei in the phosphate conversion coating. The following can be provided as examples of the phosphate powder used by the present invention: $Zn_3(PO_4)_2$, $Zn_2Fe(PO_4)_2$, $Zn_2Ni(PO_4)_2$, $Ni_3(PO_4)_2$, $Zn_2Mn(PO_4)_2$, $Mn_3(PO_4)_2$, $Mn_2Fe(PO_4)_2$, Ca3 $(PO_4)_2$, $Zn_2Ca(PO_{4)2}$, $FePO_4$, $AlPO_4$, $CoPO_4$, $Co_3(PO_4)_2$, sufficiently water insoluble hydrates of all of these phosphate salts.

The particle size of the phosphate powder used in the present invention is preferably not more than, with increasing preference in the order given, 5.0, 4.0, 3.5, 3.0, 2.5, 20, or 1.7 $\mu$m in order to also induce a stable dispersion of the insoluble material in the aqueous solution. At the same time, however, the presence in the surface conditioning liquid composition of the present invention of additional phosphate powder with particle sizes greater than 5 $\mu$m has no adverse influence whatever on the advantageous effects of the present invention, which will appear once the concentration of $\leqq 5$ $\mu$m microparticles in the surface conditioning liquid composition reaches a certain concentration.

The desired particle size, and possibly other desirable characteristics, of the solid phosphate power used in a composition according to the invention, are readily and therefore preferably obtained by grinding, most preferably ball milling, a suspension of the solid phosphate in water in which an accelerant component as defined above is dissolved until the desired particle size is achieved. If a ball mill is used, the balls are preferably of a very hard ceramic, most preferably zirconia, and independently preferably have a diameter that is not more than, with increasing preference in the order given, 5, 3, 2.0, 1.5, 1.0, 0.80, 0.70, 0.60, or 0.50 millimeters.

Not only does the phosphate powder used in the present invention form nuclei for deposition of the phosphate crystals, this powder also functions to accelerate the deposition reactions. The concentration of the phosphate powder is preferably from 0.001 to 30 g/L in order to form nuclei for phosphate crystal deposition and accelerate the initial phosphate crystal deposition reactions. A phosphate powder concentration less than 0.001 g/L (i) can not satisfactorily accelerate the initial phosphate crystal deposition reactions, because of the correspondingly small amount of phosphate powder adsorbed on the metal surface and (ii) also will not satisfactorily accelerate the reactions due to the correspondingly small number of divalent or trivalent metal phosphate particles functioning as nuclei. A phosphate powder concentration in excess of 30 g/L is simply uneconomical, because no additional acceleration of the phosphate conversion reactions is obtained at concentrations above 30 g/L.

The present inventors discovered that surface conditioning activity appears in the presence of any of the accelerant components of the present invention as described herein, even when treatment is carried out by dipping at low concentrations of the phosphate powder and without the application of any physical force to the metal surface that is greater than the force supplied by conventional process operations, such as dipping, stirring, spraying, pumping, or the like that are conventionally used with prior art titanium colloidal activators, The present invention operates simply through contact between the workpiece and the surface conditioning liquid composition and thus operates on a reaction mechanism that is entirely different from that of the prior art that requires robust physical force to accelerate solid phosphate salt particles into the surface being conditioned.

The concentration of the accelerant component in the composition is preferably from 1 to 2,000 ppm. At concentrations below 1 ppm a satisfactory surface conditioning activity usually can not be produced by simple contact between the metal workpiece and the surface conditioning liquid composition. Not only can no additional effects be expected at concentrations in excess of 2,000 ppm, but such concentrations may result in an excessive adsorption by the accelerant component on the surface of the metal workpiece and hence hinder the phosphate conversion activity.

The basic structural unit saccharide of the monosaccharides, polysaccharides, and derivatives thereof used as accelerants in the present invention can be selected from, for example, fructose, tagatose, psioose, sofbose, erythrose, threose, ribose, arabinose, xylose, lyxose, allose, altrose, glucose, mannose, gulose, idose, galactose, and talose. (For the purposes of the present invention, a substance that produces two or more saccharide units by hydrolysis of each molecule is designated as a polysaccharide and a saccharide that itself can not be hydrolyzed further to produce a lower molecular weight saccharide is designated as a monsaccharide.)

In the case of the monosaccharides, the basic structural saccharides described above will be used as such; in the case of the polysaccharides, homolysaccharides or heteropolysaccharides of the aforementioned basic structural saccharides can be used; finally, derivatives of the preceding can be afforded by the substitution of the hydrogen atom of at least one of the hydroxyls in the basic saccharide by a substituent moiety such as $—NO_2$, $—CH_3$, $—C_2H_4OH$, $—CH_2CH(OH)CH_3$, and $—CH_2COOH$. Combinations of several species of monosaccharides, polysaccharides, and derivatives thereof can also be used.

The advantageous effects of the invention are independent of the configuration and optical rotation of the basic structural saccharide and the invention can therefore use any combination of D-monosaccharides and L-monosaccharides and both dextrorotatory and levorotatory optical rotations. Nor will any problem be created by the use of the sodium or ammonium salt of the aforementioned monosaccharides, polysaccharides, and derivatives thereof in order to improve the water solubility of same. Moreover, when the preceding structures are poorly soluble in water, they can be used after preliminary dissolution in an organic solvent that is miscible with water.

Examples of suitable accelerant component substances from the above-described subgroup (2) are: pyrophosphoric acid, tripolyphosphoric acid, trimetaphosphoric acid, tetrametaphosphoric acid, hexametaphosphodc acid, aminotrimethylenephosphonic acid, 1-hydroxyethylidene-1,1-diphosphonic acid, ethylenediaminetetramethylenephosphonic acid, diethylenetriaminepentamethylenephosphonic add, and the sodium and ammonium salts of the preceding, and the sodium and ammonium salts of any of the preceding acids in this sentence. The invention can use a single selection or any combination thereof.

Subgroup (3) of suitable accelerant components as described above are exemplified by polyvinyl alcohols afforded by the hydrolysis of vinyl acetate polymers, cyanoethylated polyvinyl alcohols afforded by the cyanoethylation of such polyvinyl alcohols with acrylonitrile, formalated polyvinyl alcohols afforded by the acetalation of such polyvinyl alcohols with formaldehyde, urethanized polyvinyl alcohols afforded by the urethanation of such polyvinyl. alcohols with urea, and water-soluble polymer compounds afforded by the introduction of the carboxyl group, sulfonic group, or amide group into polyvinyl alcohol. Monomers copolymerized with vinyl acetate can be exemplified by acrylic add, crotonic acid, and maleic anhydride. The beneficial effects associated with the present invention will be fully manifested as long as the vinyl acetate polymers or derivatives thereof and/or the copolymers of vinyl acetate and monomers copolymerizable therewith are sufficiently soluble in water. As a result, these effects are independent of the degree of polymerization and degree of functional group introduction of the subject polymers. The invention can use a single selection from the above-described polymers and copolymers or can use any combination thereof.

In connection with subgroup (4) as defined above of suitable accelerant substances:

monomers that conform to general chemical formula (I) can be exemplified by methyl acrylate, ethyl acrylate, propyl acrylate, butyl acrylate, pentyl acrylate, methyl methacrylate, ethyl methacrylate, propyl methacrylate, butyl methacrylate, pentyl methacrylate, hydroxymethyl acrylate, hydroxyethyl acrylate, hydroxypropyl acrylate, hydroxybutyl acrylate, hydroxypentyl acrylate, hydroxymethyl methacrylate, hydroxyethyl methacrylate, hydroxypropyl methacrylate, hydroxybutyl methacrylate, and hydroxypentyl methacrylate; The α,β-unsaturated carboxylic acid monomers other than acrylic and methacrylic acids can be exemplified by maleic acid and crotonic acid;

monomers copolymerizable with the preceding monomers can be exemplified by styrene, vinyl chloride, and vinylsulfonic acid;

the invention can use polymer synthesized by the polymerization of a single monomer from among the preceding or copolymer synthesized by the polymerization of any combination of the preceding monomers.

The surface conditioning liquid composition according to the present invention can also contain an alkali metal salt or ammonium salt or a mixture thereof. Suitable alkali metal salts and ammonium salts are exemplified by orthophosphate salts, metaphos phate salts, orthosilicate salts, metasilicate salts, carbonate salts, bicarbonate salts, nitrate salts, nitrite salts, sulfate salts, borate salts, and organic acid salts. The invention can also use combinations of two or more selections from the aforesaid alkali metal and ammonium salts.

The alkali metal and ammonium salts used by the present invention in general will be equivalent to the alkali builders used in commercial cleaning agents. As a consequence, the activities associated with the alkali builders in commercial cleaning agents, i.e., the ability to soften hard water and cleaning activity with respect to oil, will provide activity as a cleaning agent as well as additional improvements in the liquid composition stability of the surface conditioning liquid composition used by the present invention.

The concentration of the alkali metal salt or ammonium salt is desirably from 0.5 to 20 g/L. The hard water softening activity and cleaning activity will not usually be satisfactory at concentrations below 0.5 g/L, while concentrations in excess of 20 g/L are simply uneconomical because no additional benefits are obtained at such concentrations.

Unlike the prior-art technologies, the surface conditioning liquid composition according to the present invention has the ability to retain its effects and activities in almost any use environment. Thus, the present invention provides at least one, and in favorable instances all, of the following advantages over the prior art-technologies:

(1) higher time-wise stability;

(2) less deterioration in conditioning activity when hardness components such as Ca and Mg increase in concentration in the liquid composition;

(3) ability to be used at higher temperatures;

(4) ability to be mixed with various alkali metal salts without substantial reduction in its conditioning activity; and (5) higher stability over a wider pH range.

The liquid composition according to the present invention can therefore be used to carry out degreasing and surface conditioning in a single process operation, although prior-art technologies have been unable to continuously maintain stable qualities in this type of use. In addition to the above-described alkali metal or ammonium salts, the liquid composition according to the present invention can also tolerate the addition of other known inorganic alkali builders, organic builders, and surfactants for the purpose of improving the cleaning performance in such a degreasing +surface conditioning in a single process operation. Moreover, irrespective of the execution of degreasing and surface conditioning in a single process operation, a known sequestering agent and/or condensed phosphate can be added in order to mitigate any adverse influence of cationic component carried over into the surface conditioning liquid composition.

A surface conditioning process according to the present invention may be carried out simply by effecting contact between the metal surface and a surface conditioning liquid composition according to the invention as described above; such factors as the contact time and temperature of the surface conditioning liquid composition are not usually critical. Furthermore, the surface conditioning process according to the present invention can be applied to any metal on which phosphate treatment is executed, e.g., iron and steel, zino-plated steel sheet, aluminum, aluminum alloys, and magnesium alloys.

The phosphate conversion treatment executed after the surface conditioning treatment according to the present invention can employ any methodology, e.g., dipping, spraying, electrolysis, and the like. The particular phosphate coating deposited is not critical as long as it is a phosphate conversion coating, e.g., a zinc phosphate, manganese phosphate, or calcium/zinc phosphate conversion coating.

The use of a surface conditioning liquid composition according to the present invention will be described in greater detail below through working and comparative examples. The phosphating treatment used in the examples is a zinc phosphating treatment for underpaint applications, but this treatment is provided simply as one example of phosphating treatments and in no way limits the applications of the surface conditioning liquid composition of the present invention.

Substrates

The designations and properties of the sample sheets used as the substrate surface treated In the working and comparative examples were as follows ("JIS" means "Japanese Industrial Standard" and "g/m$^2$" means "grams per square meter"):

SPC (cold-rolled steel sheet according to JIS G-3141);

EG (steel sheet electrogalvanized on both surfaces, with zinc add-on weight of 20 g/m$^2$);

GA (steel sheet, hot-dip galvannealed on both surfaces, with zinc add-on weight=45 g/m$^2$);

Zn—Ni (steel sheet, Zn/Ni alloy electroplated on both surfaces, plating weight=20 g/m$^2$);

Al (aluminum sheet according to JIS 5052); and

MP (magnesium alloy sheet according to JIS H-4201).

Process Operation Sequence

Each of the sample sheets was treated using the following sequence unless otherwise explicitly noted: alkaline degreasing→water rinse→surface conditioning treatment→formation of zinc phosphate coating→water rinse→rinse with deionized water.

In both the working and comparative examples, the alkaline degreasing used a 120 second spray at 42° C. of a solution of FINECLEANER® L4460 concentrate (a commercial product of Nihon Parkerizing Co., Ltd.) that had been diluted with tap water to 2% of the concentrate.

The surface conditioning treatment was run by dipping the workpiece in the particular surface conditioning liquid composition described below in each of the working and comparative examples.

In order to form the zinc phosphate coating, in both the working and comparative examples PALBOND® L3020 concentrate (a commercial product of Nihon Parkerizing Co., Ltd.) was diluted with tap water to 4.8% and the component concentrations, total acidity, free acidity, and accelerant concentration were adjusted to the concentrations currently in general use for automotive zinc phosphate treatments. The resulting liquid composition was contacted with the substrates by dipping them into the surface conditioning liquid composition for 120 seconds at 42° C.

Both the tap water rinse and the pure water rinse used a 30-second spray at room temperature.

Tests for Evaluating the Zinc Phosphate Coatings

The coating appearance ("CA"), coating weight ("CW"), coating crystal size ("CS"), and (only on the SPC substrates) the "P ratio" were measured, by the methods described immediately below, on the zinc phosphate coatings formed after the surface conditioning treatment.

Coating appearance (CA): the presence/absence of coating voids and nonuniformity was evaluated visually and was scored on the following scale:

++: uniform. good-quality appearance;

+: nonuniform in some regions, but with no visually apparent voids;

Δ: presence of some minor voids along with nonuniformity;

×: substantial area fraction of voids; and

××: no conversion coating present.

Coating weight (CW): The weight of the sample sheet was measured after formation of the zinc phosphate coating to give the value W1 (in grams, hereinafter usually abbreviated as "g"). The zinc phosphate coating was then stripped (stripping liquid composition and conditions given below) and the weight was again measured to give W2 (also in g). The coating weight was calculated from the following equation:

$$\text{coating weight (g/m}^2\text{)}=(W1-W2)/(\text{surface area}).$$

For the cold-rolled steel sheets the stripping liquid was 5% chromic acid (i.e., $CrO_3$) solution in water, and the stripping conditions were 75° C., 15 minutes, by dipping. For the galvanized steel sheet the stripping liquid composition was a solution containing 2% by weight of ammonium dichromate, 49% by weight of 28% by weight ammonia solution in water, and 49% by weight of pure water, and the stripping conditions were ambient temperature (i.e., 18–23° C.), 15 minutes, by dipping.

For the magnesium alloy and aluminum: The amount of elemental phosphorus in the zinc phosphate coating was quantitated using an X-ray fluorescent analyzer and the add-on weight of the coating was calculated from the P content, assuming that the coating was hopeite.

Coating crystal size (CS): The crystal size was determined by inspection of an image of the zinc phosphate coating obtained using a scanning electron microscope ("SEM") at 1,500 times magnification.

"P ratio": This value was determined by measuring the X-ray intensity of the phosphophyllite crystals ("P") and the X-ray intensity of the hopeite crystals ("h") in the zinc phosphate coating, using an x-ray diffraction instrument. The "P ratio" was calculated from the following equation, using the thus obtained x-ray intensity values: "P ratio"=p/(p+h).

Table 1 reports the compositions of surface conditioning baths provided as examples of Claim one of the present invention, Table 2 reports the compositions of the various surface conditioning baths provided as comparative examples (including some with details explained below). The monosaccharides, polysaccharides, and derivatives thereof used in the working and comparative examples were commercial products obtained from, for example, Daicel Kagaku Kogyo Kabushiki Kaisha, Dai-ichi Kogyo Seiyaku Kabushiki Kaisha, Asahi Kasei Kogyo Kabushiki Kaisha, and Dainippon Seiyaku Kabushiki Kaisha. This component was selected taking into account such factors as the type of basic structural saccharide, degree of polymerization, substituents, and degree of substitution. The substituents are exemplified for the case of glucose, a basic structural sac charide, using the following chemical structure:

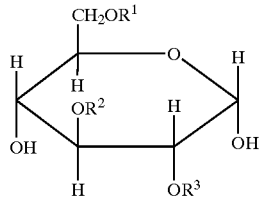

TABLE 1

| Component Type and Details | | Example 1 | Example 2 | Example 3 | Example 4 | Example 5 |
|---|---|---|---|---|---|---|
| Phosphate Salt | Chemical | PHOS | PHOS | PHOS | PHOS | PHOS |
| | Concentration, g/L | 1.0 | 1.0 | 1.0 | 1.0 | 1.0 |
| | Particle Size, $\mu$m | 0.5 | 0.5 | 0.5 | 0.5 | 0.5 |
| Monosaccharide, Polysaccharide, or Derivative Thereof | Base Monosaccharide(s) | Glucose | Glucose | Glucose | Glucose | Fructose |
| | Substituent(s) | —$CH_2COOH$, —$NO_2$ | —$CH_2COOH$, —$NO_2$ | —$CH_2CO^{OH}$ | None | None |
| | Degree of Substitution | ≦1.8 | ≦1.8 | 0.7 | 0 | 0 |
| | Degree of Polymerization | ≦3,000 | ≦3,000 | ≦100 | 1 | ≦100 |
| | Concentration, ppt | 0.005 | 1.0 | 0.010 | 2.0 | 2.0 |
| Alkali Salt | Chemical | None | None | $NaNO_2$ | $MgSO_4.7H_2O$ | None |
| | Concentration, g/L | None | None | 0.5 | 0.5 | None |
| Surfactant | Chemical | None | None | None | None | None |
| | Concentration, g/L | None | None | None | None | None |
| Treatment Conditions | Temperature, ° C. | 20 | 20 | 20 | 20 | 20 |
| | Time, Seconds | 30 | 30 | 30 | 30 | 30 |

| Component Type and Details | | Example 6 | Example 7 | Example 8 | Example 9 | Example 10 |
|---|---|---|---|---|---|---|
| Phosphate Salt | Chemical | PHOS | ZPTH | ZPTH | SCHO | SCHO |
| | Concentration, g/L | 1 | 1 | 1 | 10 | 5.0 |
| | Particle Size, $\mu$m | 0.5 | 0.6 | 1.2 | 0.4 | 0.4 |
| Monosaccharide, Polysaccharide, or Derivative Thereof | Base Monosaccharide(s) | Glucose, Xylose, and Galactose | Glucose | Glucose | Glucose | Glucose |
| | Substituent(s) | None | —$CH_2CO^{OH}$ | —$C_3H_6OH$, —$CH_3$ | —$C_2H_4OH$ | None |
| | Degree of Substitution | 0 | ≧2 | 1.9 | 1.0 | 0 |
| | Degree of Polymerization | ≦500 | ≦200 | ≦1,000 | ≦2,000 | ≦500 |
| | Concentration, ppt | 0.100 | 0.100 | 0.001 | 0.010 | 0.005 |
| Alkali Salt | Chemical | None | None | $Na_2SiO_3.5H_2O$ | $Na_2CO_3$ | $Na_3PO_4.12H_2O$ |
| | Concentration, g/L | None | None | 5.0 | 1.0 | 10 |
| Surfactant | Chemical | None | None | None | None | $(EO)_{11}NPE$ |
| | Concentration, g/L | None | None | None | None | 2.0 |
| Treatment Conditions | Temperature, ° C. | 20 | 20 | 20 | 20 | 40 |
| | Time, Seconds | 30 | 30 | 30 | 30 | 120 |

New Abbreviations in Table 1
"PHOS" means "phosphophyllite";
"ZPTH" means "$Zn_3(P^O{}_4)_2.4^H{}_2O$";
"SCHO" means "scholzite";
"$^{(EO)}{}_{11}$NPE" means "a surfactant made by ethoxylating nonyl phenol to add an average of 11 ethylene oxide residues per molecule";
"ppt" means "parts per thousand by weight".

In the case of glucose, the 3 hydroxyls at $R^1$, $R^2$, and $R^3$ can be etherified. In the examples under consideration, the type of substituent and degree of substitution (number of hydroxyl groups that have been substituted by the substituent(s) per unit of the basic structural saccharide) were varied in order to investigate the corresponding effects. The polysaccharide, or derivative thereof. In the ageing test, the surface conditioning liquid composition was allowed to stand for 10 days at room temperature after preparation and was then used.

EXAMPLE 1

A precipitate was produced by alternately adding 100 milliliters (hereinafter usually abbreviated as "mL") of a zinc sulfate solution that contained 1.0 mole/liter (hereinafter usually abbreviated as "mol/L") of zinc sulfate in water as a solvent and 100 mL of a 1.0 mol/L solution of sodium monohydrogen phosphate in water to one liter of a 0.5 mol/L solution of iron (II) sulfate in water heated to 50° C. The precipitate-containing aqueous solution was heated for one hour at 90° C. in order to ripen the precipitate particles, after which purification by decantation was carried out 10 times. The precipitate afforded by filtration was then dried and analyzed by x-ray diffraction and was confirmed to be phosphophyllite, which has the chemical formula $Zn_2Fe(PO_4)_2 \cdot 4H_2O$, containing some tertiary iron phosphate. To each one kilogram (hereinafter usually abbreviated as "kg") of this predominantly phosphophyllite powder was added 50 g of the product afforded by the preliminary dilution/dissolution of the monosaccharide, polysaccharide, or derivative thereof reported in Table 1 to 10% by weight in water and isopropyl alcohol. This was followed by milling for about one hour in a ball mill using zirconia balls with a diameter of 0.5 millimeter (hereinafter usually abbreviated as "mm"). After milling, tap water was added to adjust the phosphophyllite concentration in the suspension to 1.0 g/L, and the suspension was then used as the surface conditioning liquid composition. The average particle size of the microparticles in the suspension after adjustment was measured to be 0.5 μm, using a laser diffraction/scattering instrument for measuring particle size distribution (LA-920 from Kabushiki Kaisha Horiba Seisakusho).

EXAMPLE 2

Predominantly phosphophyllite powder was prepared in the same manner as in Example 1, and 100 g of this powder was added per 1.0 kg of the product afforded by the preliminary dilution/dissolution of the monosaccharide, polysaccharide, or derivative thereof reported in Table 1 to 10% by weight in water and isopropyl alcohol. This was followed by milling for about one hour in a ball mill using zirconia balls with a diameter of 0.5 mm. After milling, tap water was added to adjust the phosphophyllite concentration in the suspension to 1.0 g/L, and the suspension was then used as the surface conditioning liquid composition. The average particle size of the microparticles in the suspension after adjustment was measured at 0.5 μm using the same instrument as in example 1.

EXAMPLE 3

Predominantly phosphophyllite powder was prepared in the same manner as in Example 1, and to each 1.0 kg of this powder was added 100 g of the product afforded by the preliminary dilution/dissolution of the monosaccharide, polysaccharide, or derivative thereof reported in Table 1 to 10% by weight in water. This was followed by milling for about one hour in a ball mill using zirconia balls with a diameter of 0.5 mm. After milling, tap water was added to adjust the phosphophyllite concentration in the suspension to 1.0 g/L. The average particle size of the microparticles in the suspension after adjustment was measured at 0.5 μm using the same instrument as in Example 1. 0.5 g/L of sodium nitrite reagent (alkali salt) was then added and the resulting product was used as the surface conditioning liquid composition.

EXAMPLE 4

Predominantly phosphophyllite powder was prepared in the same manner as in Example 1, and 50 g of this powder was added per 1.0 kg of the product afforded by the preliminary dilution/dissolution of the monosaccharide, polysaccharide, or derivative thereof reported in Table 1 to 10% by weight in water. This was followed by milling for about one hour in a ball mill using zirconia balls with a diameter of 0.5 mm. After milling, tap water was added to adjust the phosphophyllite concentration in the suspension to 1.0 g/L. The average particle size of the microparticles in the suspension after adjustment was measured at 0.5 μm using the same instrument as in Example 1. 0.5 g/L of magnesium sulfate heptahydrate reagent (alkali salt) was

TABLE 2

| Component Type and Details | | CE 1 | CE 2 | CE 3 | CE 4 | CE 5 | CE 6 | CE 7 |
|---|---|---|---|---|---|---|---|---|
| Phosphate Salt | Chemical | PL-ZN | PL-ZN | PHOS | PHOS | PHOS | PHOS | PHOS |
| | Concentration, g/L | 1.0 | 1.0 | 1.0 | 1.0 | 1.0 | 1.0 | 1.0 |
| | Particle Size, μm | N.m. | N.m. | 0.5 | 6.5 | 6.5 | 6.5 | 6.5 |
| Monosaccharide, Polysaccharide, or Derivative Thereof | Base Monosaccharide(s) | None | None | None | Glucose | None | None | None |
| | Substitutent(s) | None | None | None | $—CH_2COOH$, $—NO_2$ | None | None | None |
| | Degree of Substitution | None | None | None | ≦1.8 | None | None | None |
| | Degree of Polymerization | None | None | None | ≦3,000 | None | None | None |
| | Concentration, ppt | None | None | None | 0.005 | None | None | None |
| Dissolved Compound of Phosphorus | | None | None | None | None | 0.50 ppt of ATMPA | None | None |
| Vinyl acetate Derivative Polymer | | None | None | None | None | None | 0.50 ppt of CMPVA | None |
| Other Polymer | | None | None | None | None | None | None | See Note 1 |
| Alkali Salt | Chemical | None | $MgSO_4 \cdot 7H_2O$ | None | None | None | None | None |
| | Concentration, g/L | None | 0.5 | None | None | None | None | None |

New Abbreviations and Other Notes for Table 2
"CE" means "Comparative Example";
"PL-ZN" means "PREPALENE ® ZN Concentration";
"N.m." means "Not measured";
"ATMPA" means "aminotrimethylenephosphonic acid";
"CMPVA" means "Carboxyl-modified poly(vinyl alcohol)"
Note 1: This Comparative Example composition contained 0.010 ppt of a polymer made by polymerizing a mixture of monomers containing 20% by weight of ethyl acrylate, 30% by weight of maleic acid, and 50% by weight of vinyl sulfonic acid.
General Note: All of the Comparison Example 1–7 compositions were contacted with substrates at 20° C. for 30 seconds.

then added and the resulting product was used as the surface conditioning liquid composition.

EXAMPLE 5

Predominantly phosphophyllite powder was prepared in the same manner as in Example 1, and 50 g of this phosphophyllite was added per 1.0 kg of the product afforded by the preliminary dilution/dissolution of the monosaccharide, polysaccharide, or derivative thereof reported in Table 1 to 10% by weight in water. This was followed by milling for about one hour in a ball mil using zirconia balls with a diameter of 0.5 mm. After milling, tap water was added to adjust the phosphophyllite concentration in the suspension to 10 g/L, and the suspension was then used as the surface conditioning liquid composition. The average particle size of the microparticles in the suspension after adjustment was measured at 0.5 $\mu$m using the same instrument as in Example 1.

EXAMPLE 6

Predominantly phosphophyllite powder was prepared in the same manner as in Example 1, and 1.0 kg of this powder was added per 1.0 kg of the product afforded by the preliminary dilution/dissolution of the monosaccharide, polysaccharide, or derivative thereof reported in Table 1 to 10% by weight in water. This was followed by milling for about one hour in a ball mill using zirconia balls with a diameter of 0.5 mm. After milling, tap water was added to adjust the phosphophyllite concentration in the suspension to 1.0 g/L, and the suspension was then used as the surface conditioning liquid composition. The average particle size of the microparticles in the suspension after adjustment was measured at 0.5 $\mu$m using the same instrument as in Example 1.

EXAMPLE 7

1.0 kg of reagent grade $Zn_3(PO_4)_2 \cdot 4H_2O$ was added per 1.0 kg of the product afforded by the preliminary dilution/dissolution of the monosaccharide, polysaccharide, or derivative thereof reported in Table 1 to 10% by weight in water. This was followed by milling for about one hour in a ball mil using zirconia balls with a diameter of 0.5 mm. After milling, tap water was added to adjust the $Zn_3(PO_4)_2 \cdot 4H_2O$ concentration in the suspension to 1.0 g/L, and the suspension was then used as the surface conditioning liquid composition. The average particle size of the microparticles in the suspension after adjustment was measured as 0.6 $\mu$m using the same instrument as in Example 1.

EXAMPLE 8

10 g of the product afforded by the preliminary dilution/dissolution of the monosaccharide, polysaccharide, or derivative thereof reported in Table 1 to 10% by weight in water was added per 1.0 kg of reagent grade $Zn_3(PO_4)_2 \cdot 4H_2O$. This was followed by milling for about one hour in a ball mill using zirconia balls with a diameter of 10 mm. After milling, tap water was added to adjust the $Zn_3(PO_4)_2 \cdot 4H_2O$ concentration in the suspension to 1.0 g/L. The average particle size of the microparticles in the suspension after adjustment was measured as 12 $\mu$m using the same instrument as in Example 1. 5 g/L of sodium metasilicate reagent (alkali salt) was then added and the resulting product was used as the surface conditioning liquid composition.

EXAMPLE 9

A precipitate was produced by the addition of 200 mL of a 1.0 mol/L solution of zinc nitrate and then 200 mL of a 1.0 mol/L solution of sodium monohydrogen phosphate to one liter of a 0.1 mol/L solution of calcium nitrate that had been heated to 50° C. The precipitate-containing aqueous solution was heated for one hour at 90° C. in order to ripen the precipitate particles, after which purification by decantation was carried out 10 times. The precipitate afforded by filtration was then dried and analyzed by x-ray diffraction and was confirmed to be scholzite, which has the chemical formula $Zn_2Ca(PO_4)_2 \cdot 2H_2O$. To each 1.0 kg of this scholzite was added 10 g of the product afforded by the preliminary dilution/dissolution of the monosaccharide, polysaccharide, or derivative thereof reported in Table 1 to 10% by weight in water. This was followed by milling for about one hour in a ball mill using zirconia balls with a diameter of 0.5 mm. After milling, tap water was added to adjust the scholzite concentration in the suspension to 10 g/L. The average particle size of the microparticles in the suspension after adjustment was measured at 0.4 $\mu$m using the same instrument as in Example 1. 1.0 g/L of sodium carbonate reagent (alkali salt) was also added and the resulting product was used as the surface conditioning liquid composition.

EXAMPLE 10

A precipitate was produced by the addition of 200 mL of a 1.0 mol/L solution of zinc nitrate and then 200 mL of a 1.0 mol/L solution of sodium monohydrogen phosphate to 1.0 liter of a 0.1 mol/L solution of calcium nitrate that had been heated to 50° C. The precipitate-containing aqueous solution was heated for one hour at 90° C. in order to ripen the precipitate particles, after which purification by decantation was carried out 10 times. The precipitate afforded by filtration was then dried and analyzed by x-ray diffraction and was confirmed to be scholzite ($Zn_2Ca(PO_4)_2 \cdot 2H_2O$). To each 1.0 kg of this scholzite was added 10 g of the product afforded by the preliminary dilution/dissolution of the monosaccharide, polysaccharide, or derivative thereof reported in Table 1 to 10% by weight in water. This was followed by milling for about one hour in a ball mill using zirconia balls with a diameter of 0.5 mm. After milling, tap water was added to adjust the scholzite concentration in the suspension to 5 g/L. The average particle size of the microparticles in the suspension after adjustment was measured at 0.4 $\mu$m using the same instrument as in Example 1. 10 g/L of trisodium phosphate reagent (alkali salt) and 2 g/L of a commercial polyoxyethylene nonylphenyl ether surfactant were also added, and the resulting product was used as the surface conditioning liquid composition. The degreasing step was not run in this example; rather, a simultaneous cleaning and surface conditioning was run directly on the unaltered antirust oil-contaminated test specimen.

COMPARATIVE EXAMPLE 1

In this comparative example, surface conditioning was run using PREPALENE® ZN aqueous solution (commercial product of Nihon Parkerizing Co., Ltd.), which is a prior-art surface conditioner. Surface conditioning was run using the standard conditions for use of this product.

COMPARATIVE EXAMPLE 2

In this comparative example, surface conditioning was run using the liquid composition afforded by the addition of 0.5 g/L magnesium sulfate heptahydrate (alkali salt) as reported in Table 2 to the PREPALENE® ZN aqueous solution identified above as a prior-art surface conditioner.

COMPARATIVE EXAMPLE 3

A predominantly phosphophyllite powder was prepared in the same manner as for Example 1. This powder was suspended in water and then ground in a ball mill using. Zirconia balls with a diameter of 0.5 mm until the average particle size in the suspension reached 0.5 μm as measured using the same instrument as in Example 1. After milling, tap water was added to adjust the phosphophyllite concentration in the suspension to 1.0 g/L, and the suspension was then used as the surface conditioning liquid composition.

COMPARATIVE EXAMPLE 4

A predominantly phosphophyllite powder was prepared in the same manner as for Example 1. This powder was ground for about 2 minutes with a mortar, then diluted with tap water and filtered across 5 μm paper filter, and the filtrate was discarded. The precipitate was thereafter dried for one hour at 80° C. To each 1.0 kg of this dried powder was added 50 g of the product afforded by the preliminary dilution/dissolution of the monosaccharide, polysaccharide, or derivative thereof reported in Table 1 to 10% by weight in water and isopropyl alcohol. The dried powder +polymeric monosaccharide, polysaccharide, or derivative thereof was then adjusted with tap water to give a dried powder concentration of 1.0 g/L, and the resulting suspension was used as the surface conditioning liquid composition. The average particle size of the microparticles in the suspension after adjustment was measured at 6.5 μm using the same instrument as in Example 1.

Table 3 reports the coating properties of conversion coatings obtained by zinc phosphating treatments that employed surface conditioning baths prepared in the working examples, and Table 4 reports the coating properties of conversion coatings obtained by zinc phosphating treatments that employed surface conditioning baths prepared in the comparative examples.

TABLE 3

| Time of Use | Measurement or Test and Unit if Applicable | Substrate | Measurement or Test Result for Example Number: 1 | 2 | 3 | 4 | 5 | 6 | 7 | 8 | 9 | 10 |
|---|---|---|---|---|---|---|---|---|---|---|---|---|
| Directly after preparation | CA | SPC | ++ | ++ | ++ | ++ | ++ | ++ | ++ | ++ | ++ | ++ |
| | | EG | ++ | ++ | ++ | ++ | ++ | ++ | ++ | ++ | ++ | ++ |
| | | GA | ++ | ++ | ++ | ++ | ++ | ++ | ++ | ++ | ++ | ++ |
| | | Al | ++ | ++ | ++ | ++ | ++ | ++ | ++ | ++ | ++ | ++ |
| | | Zn-Ni | ++ | ++ | ++ | ++ | ++ | ++ | ++ | ++ | ++ | ++ |
| | | MP | ++ | ++ | ++ | ++ | ++ | ++ | ++ | ++ | ++ | ++ |
| | CW, g/m$^2$ | SPC | 1.6 | 1.7 | 1.5 | 1.6 | 1.6 | 1.6 | 1.5 | 1.7 | 1.4 | 1.5 |
| | | EG | 1.7 | 1.9 | 1.8 | 1.7 | 1.8 | 1.7 | 1.6 | 1.7 | 1.6 | 1.7 |
| | | GA | 2.2 | 2.4 | 2.4 | 2.3 | 2.6 | 2.7 | 2.5 | 2.4 | 2.6 | 2.4 |
| | | Al | 1.9 | 1.8 | 1.8 | 1.9 | 1.6 | 1.7 | 1.7 | 1.6 | 1.7 | 1.7 |
| | | Zn-Ni | 1.6 | 1.7 | 1.6 | 1.5 | 1.6 | 1.6 | 1.7 | 1.8 | 1.6 | 1.8 |
| | | MP | 2.5 | 2.6 | 2.5 | 2.7 | 2.6 | 2.7 | 2.5 | 2.6 | 2.6 | 2.7 |
| | CS, μm | SPC | 1–2 | 1–2 | 1–2 | 1–2 | 1–2 | 1–2 | 1–2 | 1–2 | ≦1 | 1–2 |
| | | EG | 1–2 | 1–2 | 1–2 | 1–2 | 1–2 | 1–2 | 1–2 | 1–2 | 1–2 | 1–2 |
| | | GA | 2–3 | 2–3 | 2–3 | 2–3 | 2–3 | 2–3 | 2–3 | 2–3 | 1–2 | 2–3 |
| | | Al | 1–2 | 1–2 | 1–2 | 1–2 | 1–2 | 1–2 | 1–2 | 1–2 | 1–2 | 1–2 |
| | | Zn-Ni | 1–2 | 1–2 | 1–2 | 1–2 | 1–2 | 1–2 | 1–2 | 1–2 | 1–2 | 1–2 |
| | | MP | 2–3 | 2–3 | 2–3 | 2–3 | 2–3 | 2–3 | 2–3 | 2–3 | 2–3 | 2–3 |
| | PPR | SPC | 95 | 96 | 97 | 96 | 93 | 92 | 92 | 91 | 90 | 91 |
| After standing for 10 days | CA | SPC | ++ | ++ | ++ | ++ | ++ | ++ | ++ | ++ | ++ | ++ |
| | CW, g/m$^2$ | SPC | 1.5 | 1.6 | 1.6 | 1.6 | 1.6 | 1.5 | 1.5 | 1.7 | 1.5 | 1.5 |
| | CS, μm | SPC | 1–2 | 1–2 | 1–2 | 1–2 | 1–2 | 1–2 | 1–2 | 1–2 | 1–2 | 1–2 |
| | PPR | SPC | 96 | 96 | 95 | 97 | 95 | 92 | 91 | 91 | 92 | 90 |

New Abbreviation in Table 3
"PPR" means "100 × 'P ratio'"

The results in Tables 3 and 4 confirm that the timewise stability, which has been a problem for prior-art technologies, is substantially improved in the case of the surface conditioning baths according to the present invention. The effect of the monosaccharide, polysaccharide, or derivative thereof on the surface conditioning activity is also under-scored from the results in Comparative Example 3, Example 1, and Example 2. In addition, Comparative Example 3, although also inferior to Example 1 immediately after preparation of the surface conditioning liquid composition, nevertheless at that point had a surface conditioning activity that was at least equal to that of Comparative Example 1 (prior art).

However, in the case of Comparative Example 3, milling of the divalent or trivalent metal phosphate was quite difficult and a sediment of the divalent or trivalent metal

TABLE 4

| Time of Use | Measurement or Test and Unit if Applicable | Substrate | Measurement or Test Result for Comparative Example Number: 1 | 2 | 3 | 4 | 5 | 6 | 7 |
|---|---|---|---|---|---|---|---|---|---|
| Directly after preparation | CA | SPC | ++ | x | + | xx | xx | xx | xx |
| | | EG | ++ | Δ | ++ | Δ | Δ | Δ | Δ |
| | | GA | ++ | + | ++ | Δ | Δ | Δ | Δ |
| | | Al | x | xx | Δ | xx | xx | xx | xx |
| | | Zn-Ni | ++ | ++ | ++ | Δ | Δ | Δ | Δ |
| | | MP | + | x | ++ | + | + | + | + |
| | CW, $g/m^2$ | SPC | 2.4 | 3.8 | 2.0 | N.m. | N.m. | N.m. | N.m. |
| | | EG | 2.7 | 3.2 | 2.8 | 3.8 | 3.9 | 3.8 | 4.0 |
| | | GA | 3.1 | 3.5 | 3.3 | 4.4 | 4.2 | 4.3 | 4.7 |
| | | Al | 0.9 | N.m. | 1.3 | N.m. | N.m. | N.m. | N.m. |
| | | Zn-Ni | 2.5 | 3.3 | 2.7 | 3.6 | 3.4 | 3.5 | 3.5 |
| | | MP | 3.6 | 1.8 | 2.8 | 3.3 | 3.4 | 3.5 | 3.3 |
| | CS, μm | SPC | 3–4 | >10 | 2–3 | N.m. | N.m. | N.m. | N.m. |
| | | EG | 3–4 | 7–8 | 2–3 | >10 | >10 | >10 | >10 |
| | | GA | 5–6 | 7–10 | 3–4 | >10 | >10 | >10 | >10 |
| | | Al | 4–5 | N.m. | 2–3 | N.m. | N.m. | N.m. | N.m. |
| | | Zn-Ni | 3–4 | 6–9 | 2–3 | >10 | >10 | >10 | >10 |
| | | MP | 5–6 | 8–10 | 3–4 | 5–6 | 5–6 | 5–6 | 5–6 |
| | PPR | SPC | 93 | N.m. | 95 | N.m. | N.m. | N.m. | N.m. |
| After standing for 10 days | CA | SPC | x | xx | Δ | xx | xx | xx | xx |
| | CW, $g/m^2$ | SPC | 3.3 | N.m. | 2.8 | N.m. | N.m. | N.m. | N.m. |
| | CS, μm | SPC | 7–8 | N.m. | 3–4 | N.m. | N.m. | N.m. | N.m. |
| | PPR | SPC | N.m. | N.m. | 92 | N.m. | N.m. | N.m. | N.m. |

phosphate was produced in the treatment liquid composition after the elapse of 10 days. These problems with Comparative Example 3 were due to the absence of any accelerant component as described above for the invention and resulting re-aggregation of the divalant or trivalent metal phosphate. Furthermore, although this series of examples explored variations in the type of monosaccharide, polysaccharide, or derivative thereof, in the type of alkali salt, and in the treatment temperature, no changes in activity were thereby noted and dense, ricrofine crystals were produced that were equal to or superior to the crystals produced by the prior-art technologies.

Table 5 reports the compositions of surface conditioning liquid compositions used in examples of the present invention in which a water soluble compound of phosphorus was the accelerant component. Table 5 and Comparative Example 5 in Table 2 report the particular selection from orthophosphoric acid, condensed phosphoric acids, and organophosphonic acid compounds. The phosphorus compounds used in the examples in Table 5 and in Comparative Example 5 were selected from reagents and commercial products (from, for example, Monsanto Japan Ltd.) in order to explore structural variations. While the effects of the present invention do not impose limitations on the pH of the surface conditioning liquid composition, in the case of very low pH phosphorus compounds the pH of the phosphorus compound was preliminarily adjusted to neutrality using sodium hydroxide in order to prevent dissolution of the divalent or trivalent metal phosphate. Timewise testing in this series was carried out by using the surface conditioning liquid composition after it had been held for 10 days at room temperature after its preparation. Further details for the individual examples are given below.

TABLE 5

| Component Type and Details | | Example 11 | Example 12 | Example 13 | Example 14 | Example 15 |
|---|---|---|---|---|---|---|
| Phosphate Salt | Chemical | PHOS | PHOS | PHOS | ZPTH | SCHO |
| | Concentration, g/L | 5.0 | 1.0 | 1.0 | 5.0 | 10 |
| | Particle Size, μm | 0.5 | 0.5 | 1.7 | 0.6 | 0.5 |
| Dissolved Compound of Phosphorus | Chemical | TPPA | HMPA | ATMPA | HEDP | EDTMPA |
| | Concentration, g/L | 0.0010 | 0.10 | 0.50 | 0.050 | 1.0 |
| Alkali Salt | Chemical | $MgSO_4.7H_2O$ | $Na_2.SiO_2.5H_2O$ | None | $NaCO_3$ | $Na_3PO_4.12H_2O$ |
| | Concentration, g/L | 0.50 | 1.0 | None | 5.0 | 10 |
| Surfactant | Chemical | None | None | None | None | $(EO)_{11}NPE$ |
| | Concentration, g/L | None | None | None | None | 2.0 |
| Treatment Conditions | Temperature, ° C. | 20 | 20 | 20 | 20 | 40 |
| | Time, Seconds | 30 | 30 | 30 | 30 | 120 |

New Abbreviations for Table 5
"TPPA" means "tripolyphosphoric acid";
"HMPA" means "hexameta phosphoric acid";
"HEDP" means "1-hydroxy-ethylidene-1,1-diphosphonic acid";
"EDTMPA" means "ethylenediamine tetramethylene phosphonic acid".

EXAMPLE 11

Predominantly phosphophyllite powder was prepared in the same manner as for Example 1. To each 1.0 kg of this powder was added 2 g of the product afforded by the preliminary dilution/dissolution of the phosphorus compound reported in Table 5 to 10% by weight in water. This was followed by milling for about 1 hour in a ball mill using zirconia balls with a diameter of 0.5 mm. After milling, tap water was added to adjust the phosphophyllite concentration in the suspension to 5 g/L. The average particle size of the microparticles in the suspension after adjustment was measured as 0.5 $\mu$m using the same instrument as in Example 1. 0.5 g/L of magnesium sulfate heptahydrate reagent (alkali salt) was also added and the resulting product was used as the surface conditioning liquid composition.

EXAMPLE 12

Predominantly phosphophyllite powder was prepared in the same manner as for Example 1. To each 1.0 kg of this powder was added 1.0 kg of the product afforded by the preliminary dilution/dissolution of the phosphorus compound reported in Table 5 to 10% by weight in water. This was followed by milling for about 1 hour in a ball mill using zirconia balls with a diameter of 0.5 mm. After milling, tap water was added to adjust the phosphophyllite concentration in the suspension to 1.0 g/L. The average particle size of the microparticles in the suspension after adjustment was measured as 0.5 $\mu$m using the same instrument as in Example 1. 1.0 g/L of sodium metasilicate reagent (alkali salt) was also added and the resulting product was used as the surface conditioning liquid composition.

EXAMPLE 13

Predominantly phosphophyllite powder was prepared in the same manner as for is Example 1. 200 g of this powder was added per 1.0 kg of the product afforded by the preliminary dilution/dissolution of the phosphorus compound reported in Table 5 to 10% by weight in water. This was followed by milling for about 1 hour in a ball mill using zirconia balls with a diameter of 10 mm. After milling, tap water was added to adjust the phosphophyllite concentration in the suspension to 1.0 g/L, and the suspension was then used as the surface conditioning liquid composition. The average particle size of the microparticles in the suspension after adjustment was measured as 1.7 $\mu$m using the same instrument as in Example 1.

EXAMPLE 14

100 g of the product afforded by the preliminary dilution/dissolution of the phosphorus compound reported in Table 5 to 10% by weight in water was added per 1.0 kg of reagent grade $Zn_3(PO_4)_2 \cdot 4H_2O$. This was followed by milling for about 1 hour in a ball mill using zirconia balls with a diameter of 0.5 mm. After milling, tap water was added to adjust the $Zn_3(PO_4)_2 \cdot 4H_2O$ concentration in the suspension to 5 g/L. The average particle size of the microparticles in the suspension after adjustment was measured as 0.6 $\mu$m using the same instrument as in Example 1. 5 g/L of sodium carbonate reagent (alkali salt) was also added and the resulting product was used as the surface conditioning liquid composition.

EXAMPLE 15

Scholzite powder was prepared in the same manner as for Example 9. 1.0 kg of this scholzite was added per 1.0 kg of the product afforded by the preliminary dilution/dissolution of the phosphorus compound reported in Table 5 to 10% by weight in water. This was followed by milling for about 1 hour in a ball mill using zirconia balls with a diameter of 0.5 mm. After milling, tap water was added to adjust the scholzite concentration in the suspension to 10 g/L. The average particle size of the microparticles in the suspension after adjustment was measured at 0.5 $\mu$m using the same instrument as in Example 1. 10 g/L of trisodium phosphate reagent (alkali salt) and 2 g/L of a commercial polyoxyethylene nonylphenyl ether (surfactant) were also added and the resulting product was used as the surface conditioning liquid composition. The degreasing step was not run in this example; rather, a simultaneous cleaning and surface conditioning was run directly on the unaltered antirust oil-contaminated test specimen.

COMPARATIVE EXAMPLE 5

Predominantly phosphophyllite powder was prepared in the same manner as for Example 1. This powder was ground for about 2 minutes with a mortar, then diluted with tap water and filtered through 5 $\mu$m paper filter, and the filtrate was discarded. The powder was thereafter dried for 1 hour at 80° C. 100 g of this dried powder was added per 500 g of the product afforded by the preliminary dilution to 10% by weight in water of the is phosphorus compound reported for Comparative Example 5 in Table 2. The surface conditioning liquid composition was prepared by diluting with tap water to give a dried powder concentration of 1.0 g/L. The average particle size of the microparticles in the suspension after adjustment was measured at 6.5 $\mu$m using the same instrument as in Example 1.

Table 6 reports the coating properties of conversion coatings obtained by zinc phosphating treatments that employed surface conditioning baths prepared in the working examples 11–15. Comparative Example 5 in Table 4 reports the coating properties of the conversion coating obtained by a zinc phosphating treatment that employed the surface conditioning liquid composition prepared in Comparative Example 5.

The results in Tables 6 and 4 confirm that the timewise stability, which has been a problem for prior-art technologies, is substantially improved in the case of the surface conditioning baths according to the present invention. The effect of the orthophosphoric acid, condensed phosphoric acid, or organophosphonic acid compound on the surface conditioning activity is also underscored from the results in Comparative Example 3 and Example 13.

In addition, Comparative Example 3, although also inferior to Example 11 immediately after preparation of the surface conditioning liquid composition, nevertheless at that point had a surface conditioning activity that was at least equal to that of Comparative Example 1 (prior art). However, in the case of Comparative Example 3, milling of the divalant or trivalent metal phosphate was quite difficult and a sediment of the divalent or trivalent metal phosphate was produced in the treatment liquid composition after the elapse of 10 days. These problems with Comparative Example 3 were due to the absence of

TABLE 6

| Time of Use | Measurement or Test and Unit if Applicable | Substrate | Measurement or Test Result for Example Number: 11 | 12 | 13 | 14 | 15 |
|---|---|---|---|---|---|---|---|
| Directly after preparation | CA | SPC | ++ | ++ | ++ | ++ | ++ |
| | | EG | ++ | ++ | ++ | ++ | ++ |
| | | GA | ++ | ++ | ++ | ++ | ++ |
| | | Al | ++ | ++ | ++ | ++ | ++ |
| | | Zn-Ni | ++ | ++ | ++ | ++ | ++ |
| | | MP | ++ | ++ | ++ | ++ | ++ |
| | CW, g/m$^2$ | SPC | 1.7 | 1.6 | 1.8 | 1.7 | 1.7 |
| | | EG | 1.8 | 1.8 | 1.9 | 1.8 | 1.7 |
| | | GA | 2.3 | 2.2 | 2.3 | 2.2 | 2.3 |
| | | Al | 1.7 | 1.7 | 1.7 | 1.6 | 1.7 |
| | | Zn-Ni | 1.6 | 1.6 | 1.7 | 1.6 | 1.7 |
| | | MP | 2.5 | 2.4 | 2.6 | 2.5 | 2.7 |
| | CS, $\mu$m | SPC | 1–2 | 1–2 | 1–2 | 1–2 | 1–2 |
| | | EG | 1–2 | 1–2 | 1–2 | 1–2 | 1–2 |
| | | GA | 2–3 | 2–3 | 2–3 | 2–3 | 2–3 |
| | | Al | 1–2 | 1–2 | 1–2 | 1–2 | 1–2 |
| | | Zn-Ni | 1–2 | 1–2 | 1–2 | 1–2 | 1–2 |
| | | MP | 2–3 | 2–3 | 2–3 | 2–3 | 2–3 |
| | PPR | SPC | 97 | 97 | 93 | 92 | 93 |
| After standing for 10 days | CA | SPC | ++ | ++ | ++ | ++ | ++ |
| | CW, g/m$^2$ | SPC | 1.7 | 1.7 | 1.7 | 1.7 | 1.6 |
| | CS, $\mu$m | SPC | 1–2 | 1–2 | 1–2 | 1–2 | 1–2 |
| | PPR | SPC | 97 | 96 | 95 | 93 | 93 |

any accelerant component as described above for this invention and the resulting re-aggregation of the divalent or trivalent metal phosphate. Furthermore, although this series of examples explored variations in the orthophosphoric acid, condensed phosphoric acid, and organophosphonic acid compound and in the type of alkali salt and the treatment temperature, no changes in activity were thereby noted and dense, micro-fine crystals were produced that were equal to or superior to the crystals produced by the prior-art technologies.

In addition, Comparative Example 3, although also inferior to Example 11 immediately after preparation of the surface conditioning liquid composition, nevertheless at that point had a surface conditioning activity that was at least equal to that of Comparative Example 1 (prior art). However, in the case of Comparative Example 3, milling of the divalant or trivalent metal phosphate was quite difficult and a sediment of the divalent or trivalent metal phosphate was produced in the treatment liquid composition after the elapse of 10 days. These problems with Comparative Example 3 were due to the absence of is the orthophosphoric acid, condensed phosphoric acid, or organophosphonic acid compound and the resulting re-aggregation of the divalent or trivalent metal phosphate. Furthermore, although this series of examples explored variations in the orthophosphoric acid, condensed phosphoric acid, and organophosphonic acid compound and in the type of alkali salt and the treatment temperature, no changes in activity were thereby noted and dense, microfine crystals were produced that were equal to or superior to the crystals produced by the prior-art technologies.

Table 7 reports the compositions of surface conditioning baths used in examples according to the present invention when the accelerant component is a water-soluble polymer. Table 7 and Comparative Example 6 in Table 2 use the "Vinyl Acetate/Derivative Polymer" heading to report the particular selection from water-soluble polymer compounds comprising vinyl acetate polymers and derivatives thereof and copolymers of vinyl acetate and vinyl acetate-copolymerizable monomer. The vinyl acetate polymers and derivatives thereof reported in the tables were prepared by the polymerization of vinyl acetate using a peroxide initiator followed by introduction of the functional group reported in the particular example by hydrolysis, acetalation, etc. The copolymers of vinyl acetate and vinyl acetate-copolymerizable monomer were synthesized by copolymerizing vinyl acetate and the particular monomer. Timewise testing in this series was carried out by using the surface conditioning liquid composition after it had been held for 10 days at room temperature after its preparation. Further details of individual examples are given below.

EXAMPLE 16

Predominantly phosphophyllite powder was prepared in the same manner as for Example 1. To each 1.0 kg of this powder was added 2 g of the product afforded by the preliminary dilution/dissolution of the water-soluble polymer compound reported in Table 7 to 10% by weight in water. This was followed by milling for about 1 hour in a ball mill using zirconia balls with a diameter of 0.5 mm. After milling, tap water was added to adjust the phosphophyllite concentration in the suspension to 5 g/L. The average particle size of the microparticles in the suspension after adjustment was measured at 0.5 $\mu$m using the same instrument as in Example 1. 0.5 g/L of sodium metasilicate reagent (alkali salt) was also added and the resulting product was used as the surface conditioning liquid composition.

EXAMPLE 17

Predominantly phosphophyllite powder was prepared in the same manner as for Example 1. 100 g of this powder was added per 500 g of the product afforded by the preliminary dilution/dissolution of the water-soluble polymer compound reported in Table 7 to 10% by weight in water. This was followed by milling for about 1 hour in a ball mill using zirconia balls with a diameter of 0.5 mm. After milling, tap water was added to

TABLE 7

| Component Type and Details | | Example 16 | Example 17 | Example 18 | Example 19 | Example 20 |
|---|---|---|---|---|---|---|
| Phosphate Salt | Chemical | PHOS | PHOS | ZPTH | SCHO | SCHO |
| | Concentration, g/L | 5.0 | 1.0 | 1.0 | 5.0 | 30 |
| | Particle Size, $\mu$m | 0.5 | 0.5 | 0.5 | 1.6 | 0.3 |
| Vinyl Acetate/Derivative Polymer | | 0.0010 ppt of PVAc | 0.50 ppt of CMPVA | 2.0 ppt of SAMPVA | See Note 1 | See Note 2 |
| Alkali Salt | Chemical | $Na_2SiO_3.5H_2O$ | None | $MgSO_4.7H_2O$ | $NaCO_3$ | $Na_3PO_4.12H_2O$ |
| | Concentration, g/L | 0.50 | None | 0.50 | 5.0 | 10 |
| Surfactant | Chemical | None | None | None | None | $(EO)_{11}NPE$ |
| | Concentration, g/L | None | None | None | None | 2.0 |
| Treatment | Temperature, ° C. | 20 | 20 | 20 | 20 | 40 |
| Conditions | Time, Seconds | 30 | 30 | 30 | 30 | 120 |

New Abbreviations and Other Notes for Table 7
"PVAc" means "poly(vinyl acetate)";
"SAMPVA" means "sulfonic acid modified poly(vinyl alcohol)".
Note 1: This Example Composition contained 1.0 ppt of a copolymer of 80% maleic acid and 20% vinyl acetate monomers.
Note 2: This Example Composition contained 0.030 ppt of a copolymer of 70% crotonic acid and 30% vinyl acetate monomers.

adjust the phosphophyllite concentration in the suspension to 1.0 g/L, and the suspension was then used as the surface conditioning liquid composition. The average particle size of the microparticles in the suspension after adjustment was measured at 0.5 $\mu$m using the same Instrument as in Example 1.

EXAMPLE 18

50 g of reagent grade $Zn_3(PO_4)_2.4H_2O$ was added per 1.0 kg of the product afforded by the preliminary dilution/dissolution of the water-soluble polymer compound reported in Table 7 to 10% by weight in water. This was followed by milling for about 1 hour in a ball mill using zirconia balls with a diameter of 0.5 mm. After milling, tap water was added to adjust the $Zn_3(PO_4)_2.4H_2O$ concentration in the suspension to 1.0 g/L. The average particle size of the microparticles in the suspension after adjustment was measured at 0.5 $\mu$m using the same instrument as in Example 1. 0.5 g/L magnesium sulfate heptahydrate reagent (alkali salt) was also added and the resulting product was used as the surface conditioning liquid composition.

EXAMPLE 19

Scholzite powder was prepared in the same manner as in Example 9. 500 g of this scholzite was added per 1.0 kg of the product afforded by the preliminary dilution/dissolution of the water-soluble polymer compound reported in Table 7 to 10% by weight in water. This was followed by milling for about 1 hour in a ball mill using zirconia balls with a diameter of 10 mm. After milling, tap water was added to adjust the scholzite concentration in the suspension to 5 g/L. The average particle size of the microparticles in the suspension after adjustment was measured at 1.6 $\mu$m using the same instrument as in Example 1. 5 g/L of sodium carbonate reagent (alkali salt) was also added and the resulting product was used as the surface conditioning liquid composition.

EXAMPLE 20

Scholzite powder was prepared in the same manner as for Example 9. To each 1.0 kg of this scholzite was added 10 g of the product afforded by the preliminary dilution/dissolution of the water-soluble polymer compound reported in Table 7 to 10% by weight in water. This was followed by milling for about 1 hour in a ball mill using zirconia balls with a diameter of 0.5 mm. After milling, tap water was added to adjust the scholzite concentration in the suspension to 30 g/L. The average particle size of the micro-particles in the suspension after adjustment was measured at 0.3 $\mu$m using the same instrument as in Example 1. 10 g/L of tertiary sodium phosphate reagent (alkali salt) and 2 g/L of a commercial polyoxyethylene nonylphenyl ether (surfactant were also added and the resulting product was used as the surface conditioning liquid composition. The degreasing step was not run in this example; rather, a simultaneous cleaning and surface conditioning was run directly on the unaltered antirust oil-contaminated test specimen.

COMPARATIVE EXAMPLE 6

A predominantly phosphophyllite powder was prepared in the same manner as in Example 1. This powder was ground for about 2 minutes with a mortar, then diluted with tap water and filtered through 5 $\mu$m paper filter, and the filtrate was discarded. The powder was thereafter dried for 1 hour at 80° C. 100 g of this dried powder was added per 500 g of the product afforded by the preliminary dilution/dissolution to 10% by weight in water of the water-soluble polymer compound reported in Comparative Example 6 of Table 2. The surface conditioning liquid composition was obtained by adjustment with tap water to give a dried powder concentration of 1.0 g/L. The average particle size of the microparticles in the suspension after adjustment was measured at 6.5 $\mu$m using the same instrument as in Example 1.

Table 8 reports the coating properties of conversion coatings obtained by zinc phosphating treatments that employed surface conditioning baths prepared in working Examples 16–20. Comparative Example 6 in Table 4 reports the coating properties of the conversion coating obtained by a zinc phosphating treatment that employed the surface conditioning liquid composition prepared in Comparative Example 6.

TABLE 8

| Time of Use | Measurement or Test and Unit if Applicable | Substrate | Measurement or Test Result for Example Number: 16 | 17 | 18 | 19 | 20 |
|---|---|---|---|---|---|---|---|
| Directly after preparation | CA | SPC | ++ | ++ | ++ | ++ | ++ |
| | | EG | ++ | ++ | ++ | ++ | ++ |
| | | GA | ++ | ++ | ++ | ++ | ++ |
| | | Al | ++ | ++ | ++ | ++ | ++ |
| | | Zn-Ni | ++ | ++ | ++ | ++ | ++ |
| | | MP | ++ | ++ | ++ | ++ | ++ |
| | CW, $g/m^2$ | SPC | 1.7 | 1.6 | 1.7 | 1.8 | 1.4 |
| | | EG | 1.8 | 1.7 | 1.8 | 1.9 | 1.6 |
| | | GA | 2.4 | 2.2 | 2.3 | 2.4 | 2.2 |
| | | Al | 1.7 | 1.7 | 1.8 | 1.9 | 1.7 |
| | | Zn-Ni | 1.6 | 1.5 | 1.6 | 1.7 | 1.5 |
| | | MP | 2.7 | 2.6 | 2.8 | 2.6 | 2.5 |
| | CS, $\mu$m | SPC | 1–2 | 1–2 | 1–2 | 1–2 | ≦1 |
| | | EG | 1–2 | 1–2 | 1–2 | 1–2 | 1–2 |
| | | GA | 2–3 | 2–3 | 2–3 | 2–3 | 2–3 |
| | | Al | 1–2 | 1–2 | 1–2 | 1–2 | 1–2 |
| | | Zn-Ni | 1–2 | 1–2 | 1–2 | 1–2 | 1–2 |
| | | MP | 2–3 | 2–3 | 2–3 | 2–3 | 2–3 |
| | PPR | SPC | 97 | 97 | 93 | 92 | 93 |
| After standing for 10 days | CA | SPC | ++ | ++ | ++ | ++ | ++ |
| | CW, $g/m^2$ | SPC | 1.6 | 1.7 | 1.7 | 1.7 | 1.5 |
| | CS, $\mu$m | SPC | 1–2 | 1–2 | 1–2 | 1–2 | 1–2 |
| | PPR | SPC | 96 | 97 | 92 | 92 | 93 |

The results in Tables 8 and 4 confirm that the timewise stability, which has been a problem for prior-art technologies, is substantially improved in the case of the surface conditioning baths according to the present invention. The results in Comparative Example 3 and Example 17 also underscore the effect on the surface conditioning activity of the water-soluble polymer compounds comprising vinyl acetate polymers and derivatives thereof and copolymers of vinyl acetate and vinyl acetate-copolymerizable monomer. In addition, Comparative Example 3, although also inferior to Example 16 immediately after preparation of the surface conditioning liquid composition, nevertheless at that point had a surface conditioning activity that was at least equal to that of Comparative Example 1 (prior art).

However, in the case of Comparative Example 3, milling of the divalent or trivalent metal phosphate was quite difficult and a sediment of the divalent or trivalent metal phosphate was produced in the treatment liquid composition after the elapse of 10 days. These problems with Comparative Example 3 were due to the absence of any accelerant component as described above for this invention and the resulting re-aggregation of the divalent or trivalent metal phosphate. Furthermore, although this series of examples explored variations in the type of water-soluble polymer compound comprising vinyl acetate polymers and derivatives thereof and copolymers of vinyl acetate and vinyl acetate-copolymerizable monomer, in the type of alkali salt, and in the treatment temperature, no changes in activity were thereby noted and dense, microfine crystals were produced that were equal to or superior to the crystals produced by the prior-art technologies.

Table 9 reports the compositions of surface conditioning baths used in examples according to the present invention when the accelerant component was a polymer that included at least one of residues of monomers that conform to general formula (i) as given above or other $\alpha,\beta$-unsaturated carboxylic acid monomer residues. Polymer or copolymer was prepared by polymerizing the monomer(s) reported in Table 9 and Comparative Example 7 in Table 2 using ammonium persulfate as catalyst. Poorly water-soluble monomer was polymerized after emulsification using a commercial surfactant. While the effects of the present invention do not impose narrow limitations on the pH of the surface conditioning liquid composition, in the case of very low pH polymer or copolymer the pH of the polymer or copolymer was preliminarily adjusted to neutrality using sodium hydroxide in order to prevent dissolution of the divalent or trivalent metal phosphate. Timewise testing in this series was carried out by using the surface conditioning liquid composition after it had been held for 10 days at room temperature after its preparation. Additional details for particular examples are given below.

EXAMPLE 21

Predominantly phosphophyllite powder was prepared in the same manner as for Example 1. To each 1.0 kg of this powder was added 1.0 g of the product afforded by microparticles in the suspension after adjustment was measured at 0.5 $\mu$m using the same instrument as in Example 1.

EXAMPLE 23

Predominantly phosphophyllite powder was prepared in the same manner as for Example 1. 25 g of this powder was added per 1.0 kg of the product afforded by the preliminary dilution/dissolution of the polymer or copolymer reported in Table 9 to 10% by 3o weight in water. This was followed by milling for about 1 hour in a ball mill using zirconia balls with a diameter of 0.5 mm. After milling, tap water was added to adjust the phosphophyllite concentration in the suspension to 0.5 g/L. The average particle size of the microparticles in the suspension after adjustment was measured at 0.5 $\mu$m using the same instrument as in Example 1. 0.50 g/L of magnesium sulfate heptahydrate reagent (alkali salt) was also added and the resulting product was used as the surface conditioning liquid composition.

TABLE 9

| Component Type and Details | | | Characteristics for Example Numbers: 21 | 22 | 23 | 24 | 25 | 26 | 27 |
|---|---|---|---|---|---|---|---|---|---|
| Phosphate Salt | | Chemical | PHOS | PHOS | PHOS | SCHO | SCHO | ZPTH | ZPTH |
| | | Concentration, g/L | 10 | 1.0 | 0.50 | 10 | 5.0 | 1.0 | 1.0 |
| | | Particle Size, $\mu$m | 0.5 | 0.5 | 0.5 | 0.6 | 0.6 | 1.2 | 0.5 |
| Polymer Characteristics | First Monomer | Chemical | 2-Hydroxyethyl acrylate | Maleic acid | Acrylic acid | 3-Hydroxypropyl methacrylic acid | Ethyl methacrylate | Acrylic acid | Methacrylic acid |
| | | % by Weight of Monomer | 100 | 80 | 100 | 20 | 20 | 70 | 50 |
| | Second Monomer | Chemical | None | Vinyl acetate | None | Maleic acid | Maleic acid | Maleic acid | Styrenesulfonic acid |
| | | % by Weight of Monomer | None | 20 | None | 80 | 30 | 30 | 50 |
| | Third Monomer | Chemical | None | None | None | None | Vinyl sulfonic acid | None | None |
| | | % by Weight of Monomer | None | None | None | None | 50 | None | None |
| | Polymer Concentration, ppt | | 0.001 | 0.50 | 2.0 | 1.5 | 0.010 | 0.10 | 0.005 |
| Alkali Salt | | Chemical | $NaNO_2$ | None | $MgSO_4.7H_2O$ | $Na_2CO_3$ | $Na_3PO_4.12H_2O$ | $Na_2SiO_3.5H_2O$ | None |
| | | Concentration, g/L | 0.5 | None | 0.5 | 0.5 | 10 | 5 | None |
| Surfactant | | Chemical | None | None | None | None | None | $(EO)_{11}NPE$ | None |
| | | Concentration, g/L | None | None | None | None | None | 2.0 | None |
| Treatment Conditions | | ° C. | 20 | 20 | 20 | 20 | 20 | 40 | 20 |
| | | Seconds | 30 | 30 | 30 | 30 | 30 | 120 | 30 |

EXAMPLE 24

A scholzite powder was prepared in the same manner as for Example 9. To each 1.0 kg of this scholzite was added 1.5 g of the product afforded by the preliminary dilution/dissolution of the polymer or copolymer reported in Table 9 to 10% by weight in water. This was followed by milling for about 1 hour in a ball mill using zirconia balls with a diameter of 0.5 mm. After milling, tap water was added to adjust the scholzite concentration in the suspension to 10 g/L. The average particle size of the microparticles in the suspension after adjustment was measured at 0.6 $\mu$m using the same instrument as in Example 1. 1.0 g/L of sodium carbonate reagent (alkali salt) was also added and the resulting product was used as the surface conditioning liquid composition.

EXAMPLE 25

A scholzite powder was prepared in the same manner as for Example 9. To each 1.0 kg of this scholzite was added 20 g of the product afforded by the preliminary dilution/dissolution of the polymer or copolymer reported in Table 9 to 10% by weight in water. This was followed by milling for about 1 hour in a ball mill using zirconia balls with a diameter of 0.5 mm. After milling, tap water was added to adjust the scholzite concentration in the suspension to 5 g/L The average particle size of the microparticles in the suspension after adjustment was measured at 0.6 $\mu$m using the same instrument as in Example 1. 10 g/L of tertiary sodium phosphate reagent (alkali salt) was also added and Is the resulting product was used as the surface conditioning liquid composition.

EXAMPLE 26

1.0 kg of reagent grade $Zn_3(PO_4)_2.\ 4H_2O$ was added per 1.0 kg of the product afforded by the preliminary dilution/dissolution of the polymer or copolymer reported in Table 9 to 10% by weight in water. This was followed by milling for about 1 hour in a ball mill using zirconia balls with a diameter of 10 mm. After milling, tap water was added to adjust the $Zn_3(PO_4)_2.\ 4H_2O$ concentration in the suspension to 1.0 g/L. The average particle size of the microparticles in the suspension after adjustment was measured at 1.2 $\mu$m using the same instrument as in Example 1.5 g/L of sodium metasilicate reagent (alkali salt) and 2 g/L of a commercial polyoxyethylene nonylphenyl ether (surfactant) were also added and the resulting product was used as the surface conditioning liquid composition. The degreasing step was not run in this example; rather, a simultaneous cleaning and surface conditioning was run directly on the unaltered antirust oil-contaminated test specimen.

EXAMPLE 27

To each 1.0 kg of reagent grade $Zn_3(PO_4)_2.\ 4H_2O$ was added 50 g of the product afforded by the preliminary dilution/dissolution of the polymer or copolymer reported in Table 9 to 10% by weight in water. This was followed by milling for about 1 hour in a ball mill using zirconia balls with a diameter of 0.5 mm. After milling, tap water was added to adjust the $Zn_3(PO_4)_2.\ 4H_2O$ concentration in the suspension to 1.0 g/L and this suspension was used as the surface conditioning liquid composition. The average particle size of the microparticles in the suspension after adjustment was measured at 0.5 $\mu$m using the same instrument as in Example 1.

COMPARATIVE EXAMPLE 7

Predominantly phosphophyllite powder was prepared in the same manner as for Example 1. This powder was ground for about 2 minutes with a mortar, then diluted with tap water and filtered through 5 $\mu$m paper filter, and the filtrate was discarded. The powder was thereafter dried for 1 hour at 80° C. To each 1.0 kg of this dried powder was added 100 g of the product afforded by the preliminary dilution/dissolution to 10% by weight in water of the polymer or copolymer reported in Comparative Example 7 of Table 2. The mixture of dried powder +polymer or copolymer was then adjusted with tap water to give a dried powder concentration of 1.0 g/L, and the resulting suspension was used la as the surface conditioning liquid composition. The average particle size of the microparticles in the suspension after adjustment was measured at 6.5 μm using the same instrument as in Example 1.

Table 10 reports the coating properties of conversion coatings obtained by zinc phosphating treatments that employed surface conditioning baths prepared in working examples 21–27. Comparative Example 7 in Table 4 reports the coating properties of the conversion coating obtained by the zinc phosphating treatment that employed the surface conditioning liquid composition prepared in Comparative Example 7.

The results in Tables 10 and 4 confirm that the timewise stability, which has been a problem for prior-art technologies, is substantially improved in the case of the surface conditioning baths according to the present invention. The effect of the polymer or copolymer on the surface conditioning activity is also underscored from the results in Comparative Example 3, Example 22, and Example 27.

In addition, Comparative Example 3, although also inferior to Example 21 immediately after preparation of the surface conditioning liquid composition, nevertheless at that point had a surface conditioning activity that was at least equal to that of Comparative Example 1 (prior art). However, in the case of Comparative Example 3, milling of the divalent or trivalent metal phosphate was quite difficult and a sediment of the divalent or trivalent metal phosphate was produced in the treatment liquid composition after the elapse of 10 days. These problems with Comparative Example 3 were due to the absence of any accelerant component as defined above for this invention Furthermore, although this series of examples explored variations in the type of polymer or copolymer, in the type of alkali salt, and in the treatment temperature, no changes in activity were thereby noted and dense, microfine crystals were produced that were equal to or superior to the crystals produced by the prior-art technologies.

TABLE 10

| Time of Use | Measurement or Test and Unit if Applicable | Substrate | Measurement or Test Result for Example Number: 21 | 22 | 23 | 24 | 25 | 26 | 27 |
|---|---|---|---|---|---|---|---|---|---|
| Directly after preparation | CA | SPC | ++ | ++ | ++ | ++ | ++ | ++ | ++ |
| | | EG | ++ | ++ | ++ | ++ | ++ | ++ | ++ |
| | | GA | ++ | ++ | ++ | ++ | ++ | ++ | ++ |
| | | Al | ++ | ++ | ++ | ++ | ++ | ++ | ++ |
| | | Zn-Ni | ++ | ++ | ++ | ++ | ++ | ++ | ++ |
| | | MP | ++ | ++ | ++ | ++ | ++ | ++ | ++ |
| | CW, g/m$^2$ | SPC | 1.4 | 1.7 | 1.7 | 1.5 | 1.7 | 1.7 | 1.6 |
| | | EG | 1.6 | 1.8 | 1.8 | 1.7 | 1.9 | 1.9 | 1.7 |
| | | GA | 2.2 | 2.3 | 2.3 | 2.3 | 2.4 | 2.4 | 2.5 |
| | | Al | 1.7 | 1.8 | 1.8 | 1.9 | 1.8 | 1.7 | 1.9 |
| | | Zn-Ni | 1.5 | 1.7 | 1.6 | 1.5 | 1.7 | 1.6 | 1.6 |
| | | MP | 2.5 | 2.5 | 2.4 | 2.6 | 2.5 | 2.7 | 2.5 |
| | CS, μm | SPC | ≦1 | 1–2 | 1–2 | ≦1 | 1–2 | 1–2 | 1–2 |
| | | EG | 1–2 | 1–2 | 1–2 | 1–2 | 1–2 | 1–2 | 1–2 |
| | | GA | 2–3 | 2–3 | 2–3 | 2–3 | 2–3 | 2–3 | 1–2 |
| | | Al | 1–2 | 1–2 | 1–2 | 1–2 | 1–2 | 1–2 | 1–2 |
| | | Zn-Ni | 1–2 | 1–2 | 1–2 | 1–2 | 1–2 | 1–2 | 1–2 |
| | | MP | 2–3 | 2–3 | 2–3 | 2–3 | 2–3 | 2–3 | 2–3 |
| | PPR | SPC | 97 | 96 | 97 | 92 | 91 | 93 | 90 |
| After standing for 10 days | CA | SPC | ++ | ++ | ++ | ++ | ++ | ++ | ++ |
| | CW, g/m$^2$ | SPC | 1.5 | 1.7 | 1.6 | 1.6 | 1.6 | 1.8 | 1.5 |
| | CS, μm | SPC | 1–2 | 1–2 | 1–2 | 1–2 | 1–2 | 1–2 | 1–2 |
| | PPR | SPC | 96 | 97 | 96 | 92 | 93 | 91 | 94 |

BENEFITS OF THE INVENTION

The surface conditioning liquid composition according to the present invention as described hereinabove provides a substantial improvement in timewise stability, which has been a problem with the prior-art titanium colloid technology, and also supports and enables an additional microfine-sizing of the phosphate coating crystals that has been unattainable by the prior-art. As a consequence, technology that uses the surface conditioning liquid composition according to the present invention will be more economical than the prior-art technology and will still be able to provide properties at least as good as the prior-art technology.

What is claimed is:

1. A liquid composition for conditioning metal surfaces prior to phosphate conversion coating treatment thereof, said liquid composition containing an aqueous dispersion comprising the following components:

(A) a stably dispersed, undissolved solid powder component that is constituted of phosphates that contain at least one divalent or trivalent metal, the solid powder thereof having a particle size of not more than 5 μm; and (B) an accelerant component selected from the group consisting of the following subgroups:

(1) monosaccharides, polysaccharides and derivatives thereof;

(2) orthophosphoric acid, condensed phosphoric acids, and organophosphonic acid compounds;

(3) water-soluble polymers that are homopolymers or copolymers of vinyl acetate and derivatives of these homopolymers and copolymers; and (4) copolymers and polymers as afforded by the polymerization of, (a) at least one selection from:

(i) monomers, exclusive of vinyl acetate, that conform to general chemical formula (1):

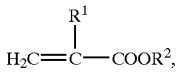

(I)

where $R^1$=H or $CH_3$ and $R^2$=H, $C_1$ to $C_5$ alkyl, or $C_1$ to $C_5$ hydroxyalkyl; and (ii) other α,β-unsaturated carboxylic acid monomers; and, optionally, (b) not more than 50% by weight of monomers that are not vinyl acetate and are not within the description of part (a) immediately above but are copolymerizable with said monomers that are within the description of said part (a).

2. A liquid composition according to claim 1 additionally comprising a component (C) of alkalinizing alkali metal, ammonium, or both alkali metal and ammonium salt dissolved in the composition.

3. A liquid composition according to claim 2 wherein:

(a) there is a concentration of from 0.001 to 30 g/L of component (A);

(b) there is a concentration of component (B) that is from 0.001 to 2.0 ppt; and (c) there is a concentration of component (C) that is from 0.5 to 20 g/L.

4. A liquid composition according to claim 3 wherein there is a concentration of from 0.10 to 30 g/L of component (A) that has a particle size not more than 1.7 μm.

5. A liquid composition according to claim 1, wherein:

(a) there is a concentration of from 0.001 to 30 g/L of component (A); and (b) there is a concentration of component (B) that is from 0.001 to 2.0 ppt.

6. A liquid composition according to claim 5 wherein there is a concentration of from 0.10 to 30 g/L of component (A) that has a particle size not more than 1.7 μm.

7. A process for producing a liquid composition for conditioning metal surfaces prior to phosphate conversion coating treatment thereof, said liquid composition containing an aqueous dispersion comprising the following components:

(A) a component of stably dispersed, undissolved solid powder that is constituted of phosphates that contain at least one divalent or trivalent metal, the solid powder thereof having a particle size of not more than 5 μm; and (B) an accelerant component selected from the group consisting of the following subgroups:

(1) monosaccharides, polysaccharides, and derivatives thereof;

(2) orthophosphoric acid, condensed phosphoric acids, and organophosphonic acid compounds;

(3) water-soluble polymers that are homopolymers or copolymers of vinyl acetate and derivatives of these homopolymers and copolymers; and (4) copolymers and polymers as afforded by the polymerization of:

(a) at least one selection from:

(i) monomers, exclusive of vinyl acetate, that conform to general chemical formula (I):

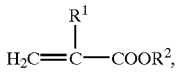

(I)

where $R^1$=H or $CH_3$ and $R^2$=H, $C_1$ to $C_5$ alkyl or $C_1$ to $C_5$ hydroxyalkyl; and (ii) other α,β-unsaturated carboxylic acid monomers; and, optionally, (b) not more than 50% by weight of monomers that are not vinyl acetate and are not within the description of part (a) immediately above but are copolymerizable with said monomers that are within the description of said part (a), said process comprising introducing at least part of both components (A) and (B) into said composition by grinding a mixture of a solid material of component (A) and a solution in water of a material of component (B) and either utilizing said mixture after grinding as said liquid composition or mixing said mixture after grinding with one or more other liquids to form said liquid composition.

8. A process for conditioning a metal surface prior to the phosphate conversion coating treatment thereof by effecting contact between said metal surface and a surface conditioning liquid composition produced according to claim 7 prior to the formation of a phosphate conversion coating on said metal surface.

9. A process according to claim 8 wherein said surface conditioning liquid composition additionally comprises dissolved in the composition (a) alkalinizing alkali metal, ammonium, or both alkali metal and ammonium salt or (b) a nonionic surfactant, an anionic surfactant, or a mixture thereof, or one or more components of both (a) and (b).

10. A process for conditioning a metal surface prior to the phosphate conversion coating treatment thereof by effecting contact between said metal surface and a surface conditioning liquid composition according to claim 6 prior to the formation of a phosphate conversion coating on said metal surface.

11. A process according to claim 10, wherein prior to the formation of a phosphate conversion coating on the metal surface, the metal surface is simultaneously activated and cleaned by contact with a surface conditioning liquid composition that additionally comprises nonionic surfactant, anionic surfactant, or a mixture thereof.

12. A process for conditioning a metal surface prior to the phosphate conversion coating treatment thereof by effecting contact between said metal surface and a surface conditioning liquid composition according to claim 3 prior to the formation of a phosphate conversion coating on said metal surface.

13. A process according to claim 12, wherein prior to the formation of a phosphate conversion coating on the metal surface, the metal surface is simultaneously activated and cleaned by contact with a surface conditioning liquid composition that additionally comprises nonionic surfactant, anionic surfactant, or a mixture thereof.

14. A process for conditioning a metal surface prior to the phosphate conversion coating treatment thereof by effecting contact between said metal surface and a surface conditioning liquid composition according to claim 2 prior to the formation of a phosphate conversion coating on said metal surface.

15. A process according to claim 14, wherein prior to the formation of a phosphate conversion coating on the metal surface, the metal surface is simultaneously activated and cleaned by contact with a surface conditioning liquid composition that additionally comprises nonionic surfactant, anionic surfactant, or a mixture thereof.

16. A process for conditioning a metal surface prior to the phosphate conversion coating treatment thereof by effecting contact between said metal surface and a surface conditioning liquid composition according to claim 1 prior to the formation of a phosphate conversion coating on said metal surface.

17. A process according to claim 16, wherein prior to the formation of a phosphate conversion coating on the metal surface, the metal surface is simultaneously activated and cleaned by contact with a surface conditioning liquid composition that additionally comprises nonionic surfactant, anionic surfactant, or a mixture thereof.

18. A process according to claim 7 wherein the grinding produces a solid powder of component (A) that has a particle size not more than 1.7 $\mu$m.

19. A process according to claim 7 wherein one or more additives selected from a group comprising (a) alkalinizing alkali metal, ammonium, or both alkali metal and ammonium salt dissolved in the composition, and (b) nonionic surfactant, anionic surfactant, or a mixture thereof are added to the resulting liquid composition.

20. A process according to claim 7 wherein the resulting liquid composition comprises (a) a concentration of component (A) that is from 0.001 to 30 g/L; and (b) a concentration of component (B) that is from 0.001 to 2.0 ppt.

21. A liquid composition for conditioning metal surfaces prior to phosphate conversion coating treatment thereof, said liquid composition containing an aqueous dispersion comprising the following components:

(A) a stably dispersed, undissolved solid powder component that is constituted of phosphates that contain at least one divalent or trivalent metal, the solid powder thereof having a particle size of not more than 5 $\mu$m; and (B) an accelerant component selected from the group consisting of the following subgroups:

(1) water-soluble polymers that are homopolymers or copolymers of vinyl acetate and derivatives of these homopolymers and copolymers; and (2) copolymers and polymers as afforded by the polymerization of:

(a) at least one selection from:

(i) monomers, exclusive of vinyl acetate, that conform to general chemical formula (I):

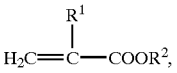

(I)

where $R^1$=H or $CH_3$ and $R^2$=H, $C_1$ to $C_5$ alkyl, or $C_1$ to $C_5$ hydroxyalkyl; and (ii) other $\alpha,\beta$-unsaturated carboxylic acid monomers; and, optionally, (b) not more than 50% by weight of monomers that are not vinyl acetate and are not within the description of part (a) immediately above but air copolymerizable with said monomers that are within the description or said part (a).

22. A liquid composition according to claim 21 additionally comprising a component (C) of alkalinizing alkali metal, ammonium, or both alkali metal and ammonium salt dissolved in the composition.

23. A liquid composition according to claim 21 wherein the solid powder of component (A) has a particle size not more than 1.7 $\mu$m.

24. A liquid composition according to claim 21 wherein (a) there is a concentration of component (A) that is from 0.001 to 30 g/L; and (b) there is a concentration of component (B) that is from 0.001 to 2.0 ppt.

25. A liquid composition according to claim 22 wherein (a) there is a concentration of component (A) that is from 0.001 to 30 g/L (b) there is a concentration of component (B) that is from 0.001 to 2.0 ppt; and (c) there is a concentration of component (C) that is from 0.5 to 20 g/L.

* * * * *

UNITED STATES PATENT AND TRADEMARK OFFICE

CERTIFICATE OF CORRECTION

PATENT NO. : 6,478,860 B1
DATED : November 12, 2002
INVENTOR(S) : Nakayama et al.

It is certified that error appears in the above-identified patent and that said Letters Patent is hereby corrected as shown below:

Title page,
Item [57], ABSTRACT,
Line 3, delete "miorosize", and insert therefor -- microsize --;
Line 5, delete "sacoharides" and insert therefor -- saccharides --.

Column 32,
Line 61, after "polysaccharides", insert -- , --.

Column 33,
Line 2, delete "," and insert therefor ":".
Line 5, "formula (1)", and insert therefor -- formula (I) --.

Column 34,
Line 7, after "$C_5$ alkyl", insert therefor -- , --.

Column 36,
Line 21, delete "air" and insert therefor -- are --.

Signed and Sealed this

Third Day of February, 2004

JON W. DUDAS
*Acting Director of the United States Patent and Trademark Office*